United States Patent [19]

Hughes

[11] 4,314,140

[45] Feb. 2, 1982

[54] PIPE THAWING APPARATUS

[76] Inventor: Douglas B. Hughes, Rideau Ferry, Ontario, Canada

[21] Appl. No.: 28,325

[22] Filed: Apr. 9, 1979

[51] Int. Cl.[3] ..... H05B 1/02; F24H 1/14

[52] U.S. Cl. ..... 219/300; 137/341; 138/33; 219/307; 219/535; 219/301

[58] Field of Search ..... 219/213, 300, 301, 307, 219/535; 137/341, 78, 79, 80, 81; 171/97; 285/16; 138/33; 307/77

[56] References Cited

U.S. PATENT DOCUMENTS

| | | | |
|---|---|---|---|
| 1,733,250 | 10/1929 | Davis, Jr. | 138/33 X |
| 2,306,831 | 12/1942 | Proctor | 219/300 |
| 2,909,638 | 10/1959 | Trabilcy | 219/300 X |
| 2,981,818 | 4/1961 | Trabilcy | 219/300 |
| 4,002,881 | 1/1977 | West | 219/301 |

*Primary Examiner*—Volodymyr Y. Mayewsky
*Attorney, Agent, or Firm*—Wenderoth, Lind & Ponack

[57] ABSTRACT

Apparatus for heating pipes and particularly for thawing frozen pipes is disclosed. The apparatus may be a self contained trailer having a generator and step-down transformer. One pair of terminals is connected to the secondary of the transformer and a pair of bus bars is also connected across the secondary. A current transformer operates a warning system indicating that the current to the first terminals is above a maximum value. This warns the operator that another pair of cables is necessary to heat effectively the pipe.

10 Claims, 1 Drawing Figure

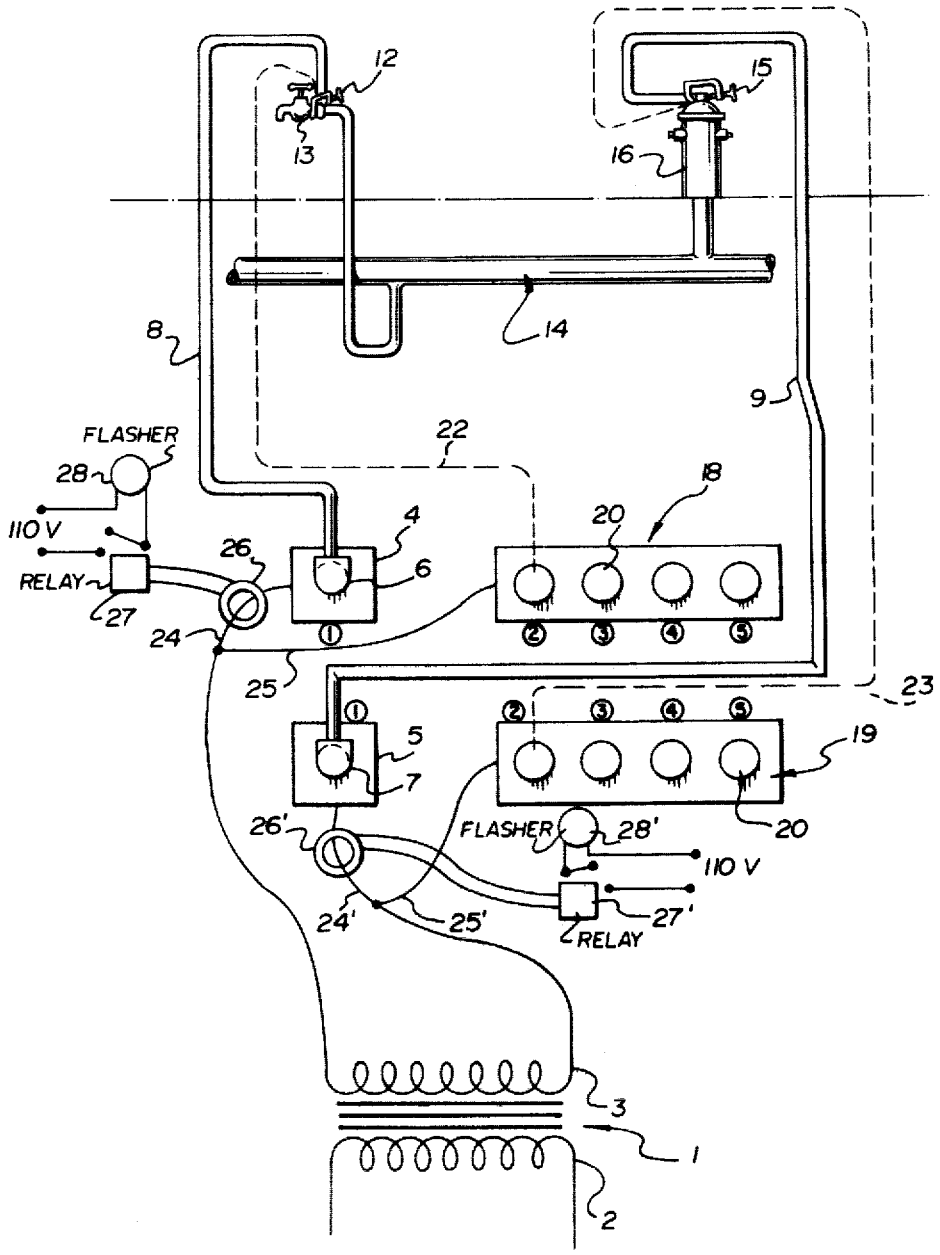
12
13
15
16
14
8
9
22
18
FLASHER
28
110 V
RELAY
27
26
4
6
20
24
25
23
5
7
19
26'
FLASHER
28'
110 V
24'
25'
27'
RELAY
3
1
2

PIPE THAWING APPARATUS

BACKGROUND OF THE INVENTION

This invention relates to an improved apparatus for electrically heating pipes and particularly thawing frozen pipes, hydrants, electric cable ducts and the like.

Such apparatus is known which comprises a movable trailer incorporating a generator, a step-down transformer and two bus bars to which electric cables can be connected. Each bus bar is arranged to accept several cables, one or more cables of one bus bar being connected to one end of a pipe (or pipe system) to be thawed and one or more cables of the other bus bar being connected to the other end of the pipe to be thawed.

One problem with the known apparatus is due to the fact that the operators generally have little knowledge of electrical theory. They connect up one pair of cables and run the machine at a current output of around 200 amps. If, after 10 minutes or so there is no evidence of thawing they simply increase the current as it seems logical that will bring about the desired result. They do not think it necessary to add more cables, which is time-consuming, when one pair of cables evidently can carry easily the increased current. This is because they do not appreciate that the resistance of the cables themselves is an important factor especially where the pipe is copper which has a very low resistance. In this case the $I^2R$ heat generated in the cables will increase at a greater rate than the $I^2R$ heat generated in the pipe and what is required is a reduction in the cable resistance which can only be accomplished by adding cables in parallel.

The effect of this misuse of the thawing apparatus is that the cables become excessively hot giving rise to a tendency for the cable connections to melt and the connections to come off. Moreover, since this increased heat is at the expense of the heat applied to the pipe it can take an unacceptably long time to thaw out a pipe and, in fact, where the cables are long or the pipe diameter is large, the pipe may never thaw. Further, because of the proportion of the $I^2R$ heat lost in the cables, a very high capacity generator is required. Additionally, because of the length of time of application of heat there is a danger of melting the lead in the joints in the pipe and of burning valve gaskets and packings.

Another effect of excessive current in the cables is a large variation in the voltage applied at the pipe between load and no-load. The result is that should the pipe circuit become open the voltage immediately rises substantially, thereby forcing an excessive current over the neutral of the electrical distribution system, which system is parallel with the water system and is not designed or intended to carry excessive current. This excessive current heats up the ground wires to the point where they can ignite combustible materials or even to the point where they fuse and create an arc.

It is an object of the present invention to obviate or mitigate the above defects.

SUMMARY OF THE INVENTION

According to the present invention there is provided apparatus for heating electrically conductive pipes electrically, comprising, a first pair of terminals connectible to a source of power, at least one other pair of terminals connectible to the source of power in parallel with first pair of terminals, current sensing means connected to sense the current flowing in at least one of the terminals of the first pair of terminals, and warning means operated by the current sensing means when the current sensing means senses a current in excess of a predetermined value.

Preferably, there is also provided further current sensing means connected to sense the current flowing in the other terminal of the first pair of terminals and further warning means operated by the further current sensing means when the current to the other terminal exceeds the predetermined value.

The operator is thus given a warning when an excess current condition exists and his standing instructions will be to add a further pair of cables between the pipe and the other pair of terminals when there is such a condition. In a preferred embodiment, not only is he provided with a warning, which may be audio or visual, but he is prevented from increasing the current through the first cable pair by means of an automatic circuit breaker which trips when the maximum permitted current is exceeded.

Each pair of terminals should be numbered consecutively to remove any doubt as to the sequence in which cable pairs have to be attached. To further reduce the risk of improper operation a current sensing means may be provided to sense the current at each terminal and provide a warning and/or operate the circuit breaker when current to any terminal exceeds the predetermined limit.

The effect of doubling the number of parallel connected cables is to half the resistance and the voltage drop along the cables. Thus, the effective voltage applied to the pipe is increased considerably which causes a consequent increase in the heating current in the pipe.

BRIEF DESCRIPTION OF THE DRAWINGS

The invention will now be described in greater detail with reference to the accompanying drawings the single FIGURE of which is a diagrammatic view of a pipe thawing machine embodying the invention.

DESCRIPTION OF THE PREFERRED EMBODIMENT

The apparatus includes a step-down transformer 1 having a primary coil 2 and a secondary coil 3. The primary coil 2 is wound to accept the H.V. output of a diesel generator (not shown), and is tapped so that the voltage derived on the secondary coil 3 may be varied up to a maximum of 45 volts, the current in the coil 3 being up to 1500 amperes.

Each end of secondary coil 3 is connected to a terminal 4 and 5, respectively, which are each formed with a projecting stud or socket receiving a connector 6 and 7, respectively connected to an end of a flexible cable 8 and a flexible cable 9.

The other end of cable 8 is provided with a suitable connector, such as a screw-clamp connector 12 for connecting the cable to a water tap 13 defining one end of the pipe system 14 to be thawed. The other end of cable 9 is also provided with a screw-clamp 15 for connecting the cable 9 to a hydrant 16 defining the other end of the pipe system to be thawed.

Each end of secondary coil 3 is also connected to a respective bus 18 or 19. Each bus 18 or 19 is formed with one or more, four in this embodiment, studs 20 identical to the studs of terminals 4 and 5. It should be clear that up to four more flexible cables similar to the cables 8 and 9 may be connected from each bus 18 or 19 to the tap 13 and the hydrant 16, respectively, in the same way that the cables 8 and 9 are connected. As an example, the first stud of bus 18 is shown connected to the tap 13 by a dotted line 22 representing a flexible cable connection and the first stud of bus 19 is shown connected to the hydrant 16 by a dotted line 23 also representing a flexible cable.

It can be seen that each end of the secondary 3 is branched forming two branches 24 and 25 (and 24' and 25') at each end, these branches forming the connection between the secondary and the terminal 4 and bus 18 (and terminal 5 and bus 19).

A current transformer 26 (26') is received on each branch 24 (24') and the output of the current transformer is connected as the input of a relay 27 (27') arranged to operate at a voltage corresponding to a current of 250 amps in the branch 24 (24'). Actuation of the relay 27 (27') causes energisation of a warning light or flasher 28 (28') and/or an audible signal.

The apparatus described above is preferably incorporated in a self-contained unit which may be towed to the site at which pipe thawing is to be carried out. The unit houses the diesel electric generator, step-down transformer, current transformers and relays. The terminals 4 and 5 and the busses 18 and 19 are mounted on end of the housing in the configuration shown and the flashers 28 and 28' are mounted adjacent the respective terminals 4 and 5.

In operation, with the unit as the location of the frozen pipe, the operator attaches cables 8 and 9 as shown and runs the generator with the primary tap adjusted to give a current output of less than 250 amps. This current flows through the circuit comprising the secondary 3, cable 8, connector 17, tap 13, pipe 14, hydrant 16, connector 15 and cable 9. The $I^2R$ heat losses in the tap 13, pipe 14 and hydrant 16 tend to thaw the tap, pipe or hydrant as the case may be. If after some 10 minutes or so there is no evidence that the thawing is effective it is obvious that the $I^2R$ loss is insufficient and greater current flow is necessary. If the operator simply increases the current output the flashers 28 and 28' will operate at the 250 amp level warning him that at least one more pair of cables is needed. The operator will, therefore, add the cables indicated by the dotted lines and crank up the generator until the current output in the secondary is considerably above 250 amps, possibly as high as 1500 amps.

It may be found necessary to increase the current still further to effect thawing and this may be done providing that sufficient cables are added to ensure that the flashers 29 and 28' are extinguished.

It is envisaged that the invention need not incorporate a generator as the necessary power may be drawn directly from the electrical power company supply.

The apparatus according to the invention may also be provided with an additional warning light or buzzer on the actual control panel which is remote from the bus bars.

The apparatus of the invention may additionally be provided with automatic tripping means in the form of a circuit breaker energised by the current transformer 26, for example, to break the supply from the secondary winding 3 if the current exceeds a predetermined value—350 amps for example.

In practice, the pairs of terminals might be formed in the side of the housing of the pipe thawing machine somewhat as shown or they might be formed in two vertical columns rather than horizontal rows. In either case, the bus bars would not be visible and to differentiate clearly the pairs of terminals and indicate clearly the intended order of connection, the housing could be provided with consecutive numbering adjacent the terminal pairs as shown in numerals 1 to 5.

As a modification, a current transformer, relay and flasher could be provided for each terminal, the flasher being disposed adjacent the appropriate terminal.

What I claim as my invention is:

1. An apparatus for heating electrically conductive pipes electrically by passing an electric current through said pipes, comprising:

a source of low voltage, high current power;

means for varying said current;

a pair of terminals connected across said source of power;

at least one other pair of terminals connected across said source of power;

a pair of electrical cables adapted for selective electrical interconnection of said pair of terminals to two respective spaced locations of a pipe to be heated;

a plurality of other pairs of electrical cables adapted for selective electrical interconnection of said at least one of other pair of terminals to said two respective spaced locations of said pipe;

current sensing means arranged so as to sense the current flowing in at least one of the terminals of said first pair of terminals when said first pair of cables in interconnected between said first pair of terminals and said two spaced locations of said pipe; and warning means operatively connected to said current sensing means for providing a warning when said current sensing means senses a current in excess of a predetermined value;

wherein when said warning is provided, an operator of said apparatus shall manually increase the total number of pairs of electrical cables connected between said source of power and said two respective spaced locations of said pipe, whereby the maximum power handling capability of each of said pairs and said plurality of other pairs of electrical cables and terminals is not exceeded.

2. An apparatus in accordance with claim 1 wherein said at least one other pair of terminals is respectively formed on a pair of bus bars.

3. An apparatus in accordance with claims 1 or 2, wherein said warning means comprises a visual warning means.

4. An apparatus in accordance with claims 1 or 2, wherein said warning means comprises an audio warning means.

5. An apparatus in accordance with claim 1 wherein said current sensing means comprises a current transformer.

6. An apparatus in accordance with claim 5, wherein said current transformer is electrically connected to a relay operable to energize said warning means.

7. An apparatus in accordance with claim 2, wherein said warning means comprises a visual warning means located physically adjacent one of said pair of terminals and one of said pair of bus bars and further comprises visual warning means physically located adjacent the other of said pair of terminals and said other of said pair of bus bars.

8. An apparatus in accordance with claims 1 or 2, further comprising an automatic tripping means energizable by said current sensing means so as to interrupt said source of power when said sensed current exceeds a predetermined value.

9. An apparatus in accordance with claims 1 or 2, further comprising additional sensing means arranged so as to sense the current flowing in at least one of the terminals of said at least one other pair of terminals.

10. An apparatus in accordance with claims 1 or 2, wherein indicia is provided adjacent said pairs of terminals and said at least one other pair of terminals so as to indicate a sequence of pairs of terminals, said pair of terminals being first in said sequence.

* * * * *